US005867190A

United States Patent [19]

Kagayama

[11] Patent Number: 5,867,190

[45] Date of Patent: Feb. 2, 1999

[54] IMAGE FORMING UNIT WITH CONTROL ELECTRODES ARRANGED TO BE ELECTRICALLY INSULATED FROM EACH OTHER

[75] Inventor: Shigeru Kagayama, Owariasahi, Japan

[73] Assignee: Brother Kogyo Kabushiki Kaisha, Nagoya, Japan

[21] Appl. No.: 262,547

[22] Filed: Jun. 20, 1994

[30] Foreign Application Priority Data

Aug. 30, 1993 [JP] Japan ..... 5-213713

[51] Int. Cl.[6] ..... B41J 2/06

[52] U.S. Cl. ..... 347/55; 347/151; 347/125

[58] Field of Search ..... 347/55, 204, 206, 347/111, 112, 120, 141, 147, 151; 355/261, 262

[56] References Cited

U.S. PATENT DOCUMENTS 3,689,935 9/1972 Pressman et al. ..... 347/55
5,036,341 7/1991 Larsson ..... 347/55
5,404,159 4/1995 Ohashi ..... 347/55
5,515,084 5/1996 Larson ..... 347/55

FOREIGN PATENT DOCUMENTS 4-141454 5/1992 Japan ..... 347/55

*Primary Examiner*—Benjamin R. Fuller
*Assistant Examiner*—C. Dickens
*Attorney, Agent, or Firm*—Oliff & Berridge, PLC

[57] ABSTRACT

An aperture electrode unit mounted in an image forming apparatus includes a polyimide insulating sheet, plural apertures, substantially T-shaped control electrode portions each of which is provided at a part of the peripheral edge of each aperture, and conductive wiring portions extending from the control electrode portions to the downstream side of a toner supply direction. With this construction, a minimum distance can be kept between a control electrode portion and a conductive wiring portion, which are adjacent to each other. So, no breakdown occurs, and image quality can be improved.

25 Claims, 16 Drawing Sheets

IMAGE FORMING UNIT WITH CONTROL ELECTRODES ARRANGED TO BE ELECTRICALLY INSULATED FROM EACH OTHER

BACKGROUND OF THE INVENTION

1. Field of the Invention

This invention relates to an image forming apparatus for use in a reproduction device, such as a copying machine, a printer, a plotter, or a facsimile machine.

2. Description of Related Art

A known image forming apparatus forms an image using a toner flow control means having plural openings (hereinafter referred to as "apertures"). In this image forming apparatus, a voltage is selectively applied to the toner flow control means in accordance with image data to control toner particles to selectively pass through the apertures to form an image on a supporter (image forming medium) with the toner particles that pass through the apertures of the toner flow control means. This type of image forming apparatus is disclosed in the specification of U.S. Pat. No. 3,689,935, for example.

This image forming apparatus includes an aperture electrode unit serving as the toner flow control means, a potential supply means, and a toner supply means and a positioning means. The aperture electrode unit includes an insulating flat plate, a reference electrode, plural control electrodes and plural apertures. The reference electrode is continuously formed on one side surface of the flat surface. The plural control electrodes are electrically insulated from one another and formed on the other surface of the flat plate. The apertures are formed in a row in correspondence with the respective control electrodes to penetrate through the insulating flat plate, the reference electrode and the control electrodes.

The voltage supply means selectively applies a potential across the control electrodes and the reference electrode of the aperture electrode unit on the basis of the image data. The toner supply means supplies charged toner particles to the lower side of the aperture electrode unit so that the flow of the toner particles passing through the apertures is modulated in accordance with the potential applied to the aperture electrode unit. The positioning means serves to feed and position the supporter in a particle-flowing path so as to be movable relatively to the aperture electrode unit.

In the conventional image forming apparatus as described above, the aperture electrode unit is designed so that the reference electrodes are disposed on one surface of the flat plate and the plural control electrodes are disposed on the other surface of the flat plate. An electric field for controlling the charged toner is formed between the control electrodes and the reference electrode. Accordingly, to control the charged toner supplied to the peripheral portion of the aperture electrode unit from the toner supply means, a strong electric field must be formed between the control electrodes and the reference electrode. Therefore, a voltage supply means, which is capable of applying a high voltage, is required to form a strong electric field between the control electrodes and the reference electrode. So, the total cost of the apparatus is increased.

To solve this problem, the applicant of this application has proposed an image forming apparatus equipped with an aperture electrode unit 200 as shown in FIG. 10. The aperture electrode unit 200 comprises an polyimide insulating sheet 202 of 25 $\mu$m thickness, plural control electrodes provided independently of one another and plural apertures 206.

The control electrodes 204 of 1 $\mu$m thickness are provided on one surface of the insulating sheet 202. Each of the control electrodes 204 comprises an operating portion 204A disposed to surround each aperture 206 and a wiring portion (non-operating portion) 204B disposed to extend from each aperture 206 to one end portion of the insulating sheet 202. The apertures 206 are provided in correspondence with the respective control electrodes 204 to penetrate through the control electrodes 204 and the insulating sheet 202. These apertures 206 are designed to be substantially 150 $\mu$m in diameter and are formed in a row in a longitudinal direction of the insulating sheet 202. The recording density of the aperture electrode unit 200 is set to 200 dpi(dot/inch).

The aperture electrode unit 200 is slightly pressed against a toner carry roller (not shown) to be in slight contact with the toner carry roller, and a voltage is applied across the control electrodes 204 and the toner carry roller. When the aperture electrode unit 200 thus constructed is applied to an image forming apparatus, an electric field is formed between the control electrodes 204 and the toner carry roller carrying charged toner thereon when a control voltage is applied to the control electrodes 204. So, a toner flow occurs between the control electrodes 204 and the toner carry roller. Therefore, as compared to the image forming apparatus described above, the toner flow can be controlled with an extremely lower voltage. In this case, in the vicinity of the contact portion between the aperture electrode unit 200 and the toner carry roller, the toner on the toner carry roller can pass through the apertures with the assistance of the electric field formed through the insulating sheet 202 between the operating portions 204A of the control electrodes 204 and the toner carry roller. The wiring portions 204B of the control electrodes are disposed at upstream and downstream sides in a rotation direction of the toner carry roller, that is, at upstream and downstream sides in a toner feeding direction.

However, the image forming apparatus as described above has the following problem. That is, controllability of charged toner particles in the aperture electrode unit is low. Thus, there occurs a phenomenon that toner is attached to even a non-image forming portion of a supporter (image forming medium), so that contrast in density of an image is degraded. By analyzing the cause of this phenomenon, it has been found out that conductive wires used to apply a control voltage to the control electrodes and drawn out from the control electrodes may have an adverse effect on an image forming process. That is, it is presumed that the following mechanism occurs to induce the above phenomenon. During an image forming process, when a control voltage is applied to the control electrodes through conductive wire portions drawn out to the upstream side of the toner feeding direction, toner particles on the toner carry roller are adsorbed onto a surface of the aperture electrode unit that faces the toner carry roller by an electric field formed by the conductive wire portions. These adsorbed toner particles are released from the surface of the aperture electrode unit when a non-image portion is formed on the supporter. At this time, some of these toner particles are blown out from the apertures to the supporter against an effect of the control voltage. So, the toner is unintentionally attached to the non-image forming portion on the supporter.

To solve this problem, it may be proposed to merely locate the conductive wiring portions of the control electrodes only at the downstream side of the toner feeding direction. However, this is practically very difficult for the following reason. For example, consider a case where an aperture electrode unit 210 as shown in FIG. 11A is used to obtain the same recording density (200 dpi) as the aperture electrode unit 200. FIG. 11B is an enlarged perspective view of a part of the aperture electrode unit 210. In this aperture electrode unit 210, the aperture pitch between respective apertures 216 is set to 125 μm in order to attain the recording density of 200 dpi. The apertures 216 are arranged in a staggered form and designed to be substantially 150 μm in diameter. Further, a control electrode 214 having a line width of about 30 μm is provided to surround each of the apertures 215. The control electrode 214 for each aperture 216 is provided with a conductive wiring portion 218 having a line width of about 30 μm. The line width of the control electrodes 214 and the conductive wiring portion 218 is more effective when as small as possible. In addition, although it is possible to set the line width to a value smaller than substantially 30 μm, it is difficult in manufacturing process capability and manufacturing cost to narrow the line width below 30 μm. Therefore, the line width of the control electrodes 214 and the conductive wiring portions is set to substantially 30 μm. If the apertures 216, the control electrodes 214 and the conductive wiring portions 218 are designed as described above, the control electrodes 214 and the conductive wiring portions 218 adjacent to the control electrodes 214 are spaced from each other only at the minimum distance of 5 μm. There is a problem that such a short distance is liable to induce a discharge between the control electrodes 214 and the adjacent conductive wiring portions 218. The line width of the control electrodes 214 and the adjacent conductive wiring portions 218 are set to be small, and the distance between the control electrodes 214 and the adjacent conductive wiring portions 218 are set be large to prevent occurrence of the discharge in this structure. However, as described above, it is difficult in manufacturing process capability and manufacturing cost to further narrow the line width of the control electrodes and the conductive wiring portions.

SUMMARY OF THE INVENTION

An object of this invention is to provide an excellent image forming apparatus that can provide an excellent image quality without significantly reducing the line width (i.e., slenderizing the lines) of the control electrodes and the conductive wiring portions.

To attain the above and other objects, an image forming apparatus according to embodiments of this invention includes a carry member for carrying and supplying charged particles, electric field control means disposed to face the carry member through the charged particles, and a counter electrode disposed to face the electric field control means through an image receiving member. The electric field control means comprises at least plural apertures through which the charged particles can pass, control electrode portions each provided at a part of the periphery of each aperture, and conductive wiring portions each provided to extend from each control electrode portion to a downstream side in a supply direction of the charged particles.

According to the image forming apparatus thus constructed, even when the conductive wiring portions are disposed at the downstream side of the supply direction of the charged particles and when the conductive wiring portions are designed to have the same line width as the prior art, the conductive wiring portions can be spaced from the control electrodes adjacent to the conductive wiring portions at a sufficient distance. Therefore, a manufacturing process can be performed without much load, and excellent image quality can be obtained.

BRIEF DESCRIPTION OF THE DRAWINGS

A preferred embodiment of the present invention is described in detail with reference to the following figures wherein.

DETAILED DESCRIPTION OF PREFERRED EMBODIMENTS

Preferred embodiments according to this invention are described hereunder with reference to the accompanying drawings.

Figure 1:
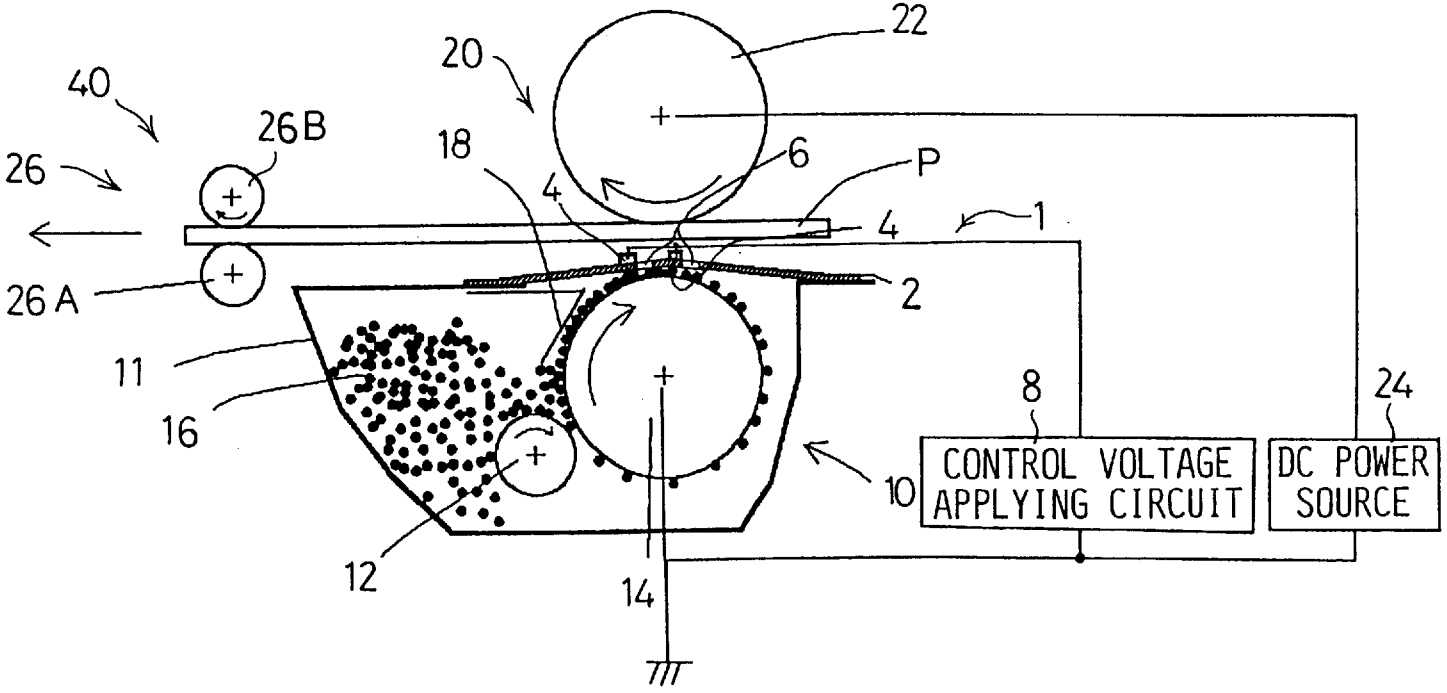
FIG. 1 schematically shows the construction of an image forming apparatus according to this invention.

FIG. 1 schematically shows a main part of an image forming apparatus in which an aperture electrode unit 1 of a first embodiment is installed. The image forming apparatus mainly comprises a toner supply portion 10, a toner control portion 20 and a supporter feeding portion 40.

The toner supply portion 10 comprises a toner case 11 also used as a housing for the whole toner supply portion 10, toner 16 accommodated in the toner case 11, a toner supply roller 12, a toner carry roller 14 and a toner layer restricting blade 18.

The toner supply roller 12 is disposed in the toner case 11 to be rotatable in a direction as indicated by an arrow of FIG. 1. The toner supply roller 12 frictionally contacts with the toner 16 in the toner case 11 to negatively charge the toner 16 and electrically attract the charged toner 16 onto the surface of the toner supply roller 12.

The toner carry roller 14 is also disposed in the toner case 11 to be rotatable in a direction as indicated by an arrow of FIG. 1. The toner carry roller 14 is disposed substantially in contact with and in parallel to the toner supply roller 12. Accordingly, the toner carry roller 14 also frictionally contacts the charged toner 16, which is fed while electrostatically attracted onto the surface of the toner supply roller 12, thereby further negatively charging the toner 16. Thereafter, the toner carry roller 14 electrostatically attracts the charged toner 16 to the surface thereof and carries the charged toner 16 thereon to feed the charged toner toward the aperture electrode unit 1. The toner carry roller 14 is grounded. The toner layer restricting blade 18 is pressed against the toner carry roller 14 and serves to adjust the amount of the toner carried on the toner carry roller 14 to be substantially uniform over the surface of the roller 14 and charge the toner 16 substantially uniformly. The toner supply portion 10 as described above is disposed along the longitudinal direction of the aperture electrode unit 1 as described later, that is, in a vertical direction of FIG. 1.

The toner control portion 20 comprises the aperture electrode unit 1, a control voltage applying circuit 8, a back electrode roller 22 and a DC power source 24.

Figure 2A:
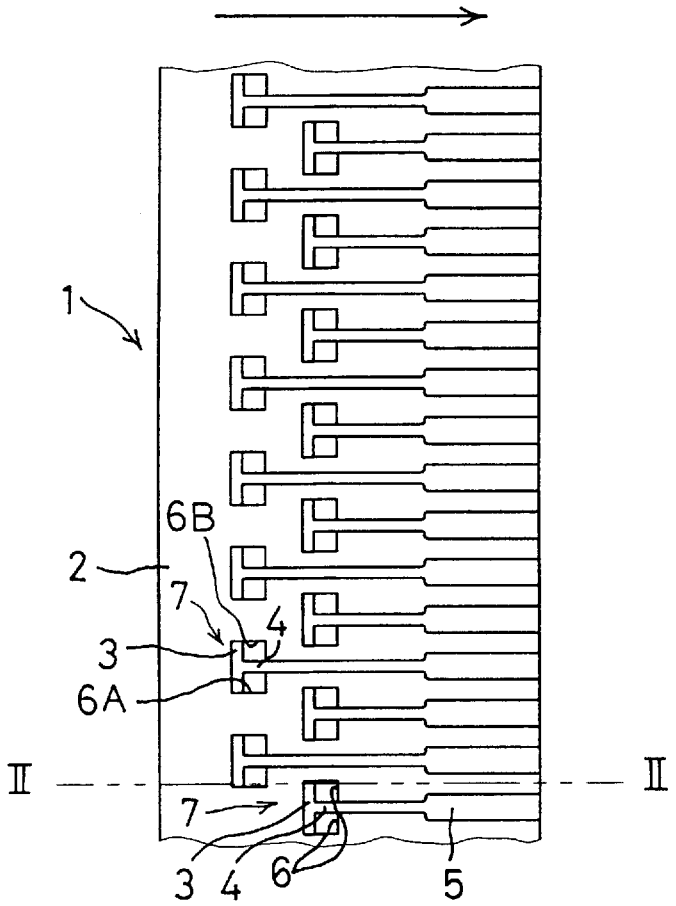
FIG. 2A is a partial plan view showing the construction of an aperture electrode unit of a first embodiment according to this invention.
Figure 2B:
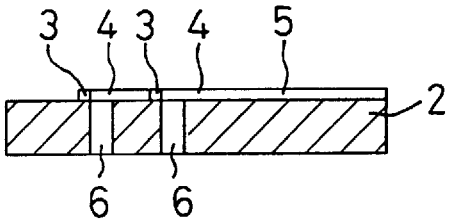
FIG. 2B is a cross-sectional side view of the aperture electrode unit of the first embodiment according to this invention.
Figure 2C:
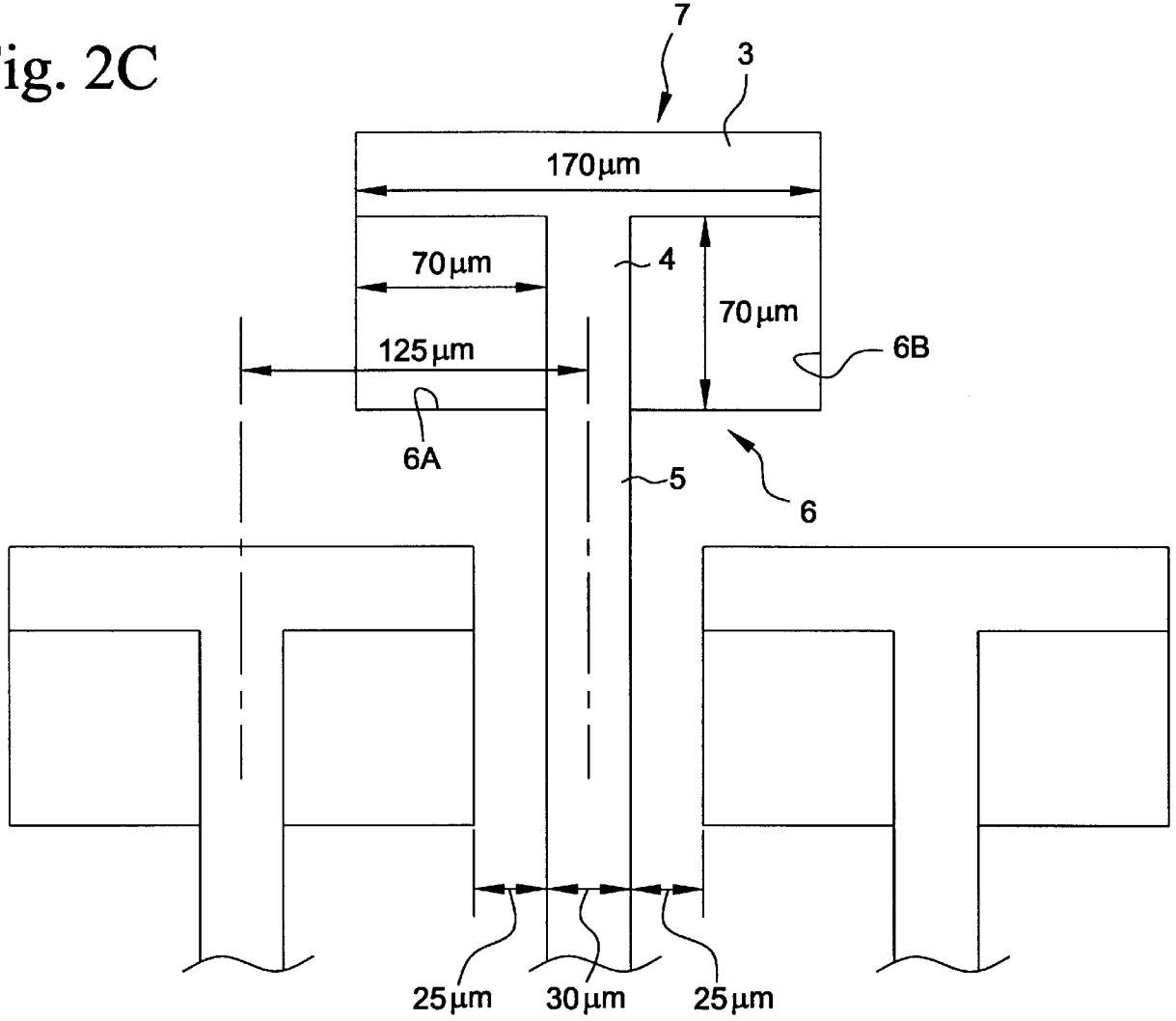
FIG. 2C is an enlarged plan view of a part of the aperture electrode unit of the first embodiment of the invention.

Next, the construction of the aperture electrode unit 1 of the first embodiment is described with reference to FIGS. 2A to 2C.

The aperture electrode unit 1 comprises a polyimide insulating sheet 2 of substantially 25 $\mu$m thickness, plural apertures 6A, 6B provided to penetrate through the insulating sheet 2, control electrode portions 7 each of which is designed to be substantially T-shaped and provided at a part of the peripheral edge of each of the apertures 6A, 6B, and conductive wiring portions 5 extending from the control electrode portions 7 to the downstream side of the supply direction of the toner 16. The control electrode portions 7 and the conductive wiring portions 5 are formed on one surface of the insulating sheet 2.

Each of the apertures 6A, 6B comprises a square aperture having one side length equal to about 70 $\mu$m. A pair of two apertures 6A and 6B are spaced from each other at an interval of substantially 30 $\mu$m (corresponding to the width of a second control electrode 4), collectively called an aperture 6. Respective pairs of apertures 6 are alternately arranged in a staggered form. A pair of first and second control electrodes 3 and 4, which preferably have 1 $\mu$m thickness and constitute a control electrode portion 7, are provided at the peripheral edge of each aperture 6 on the upper surface of the insulating sheet 2 in correspondence with each aperture 6 (i.e., a pair of apertures 6A and 6B).

The first control electrode 3 of about 30 $\mu$m width is provided to extend in a direction perpendicular to the toner feeding direction along the peripheral edge of the aperture 6 at the upstream side of the toner feeding direction. The second control electrode 4 of about 30 $\mu$m width is provided to extend from the substantially central portion of the first control electrode 3 through a gap between the apertures 6A and 6B to the downstream side of the toner feeding direction in parallel to the toner feeding direction. Further, the second control electrode 4 is connected to a conductive wiring portion 5 connected to a driving IC (not shown).

In the image forming apparatus of this embodiment, the pitch of the apertures 6 should be set to 125 $\mu$m to obtain a recording density of 200 dpi, for example. Further, since the length of the first control electrode 3 is set to about 170 $\mu$m and the minimum width of the conductive wiring portion 5 is set to about 30 $\mu$m, about 25 $\mu$m can be kept as the minimum distance between the first control electrode 3 and the conductive wiring portion 5, which are adjacent to each other. In this embodiment, a voltage of +50V is applied to the control electrode portions 7 and the conductive wiring portions 5. Thus, at least 10 $\mu$m is required for the distance between the first control electrode 3 and the conductive wiring portion 5 that are adjacent to each other. However, in this case, about 25 $\mu$m can be kept as the minimum distance between the first control electrode 3 and the conductive wiring portion 5 that are adjacent to each other, so that no discharge occurs between the first control electrode 3 and the conductive wiring portion 5 that are adjacent to each other. Further, it is needless to say that the minimum distance between the first control electrode 3 and the conductive wiring portion 5 that are adjacent to each other is varied in accordance with variation of a voltage to be applied to the control electrode portion 7 and the conductive wiring portion 5.

The aperture electrode unit 1 is pressed against the toner carry roller 14 at the aperture position of the insulating sheet 2 while the control electrode portions 7 thereof confront the supporter P as shown in FIG. 1.

Figure 3A:
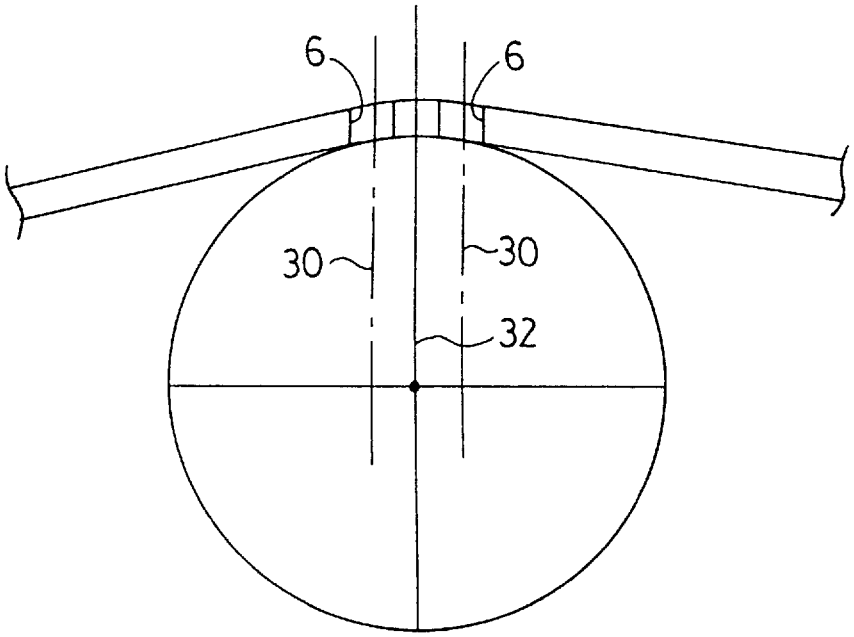
FIG. 3A is a schematic side view showing the positional relationship between an aperture electrode unit having apertures arranged in a staggered form and a toner carry roller.

Here, the detailed positional relationship between the apertures 6 of the aperture electrode unit 1 and the toner carry roller 14 is described. As shown in FIG. 3A, each of two apertures 6 arranged in a staggered form is disposed so that the central line 30 thereof passes over the substantially uppermost portion on the peripheral surface of the toner carry roller 14 and is substantially in parallel to the central axis 32 of the vertical direction of the toner carry roller 14. With this arrangement, each aperture 6 is disposed to be symmetrical at right and left sides with respect to the uppermost portion on the peripheral surface of the toner carry roller 14 so that the toner 16 passing through each aperture 6 can be uniformly distributed over the whole area of the aperture 6. Further, the wall surface of the aperture 6 and the transfer direction of the toner 16 are parallel to each other so that the toner 16 can transfer stably.

Further, the aperture electrode unit 1 itself is pressed against the toner carry roller 14 so that it can be bent to the right and left sides with respect to the toner carry roller 14 by the same angle. With this construction, the contact area between the aperture electrode unit 1 and the toner carry roller 14 can be increased, and the periphery of the lower portion of each aperture 6 can be pressed uniformly at the right and left sides. So, the occurrence of non-uniformity of toner density can be prevented at a maximum.

The control electrodes 3, 4 are connected to the control voltage applying circuit 8. The control voltage applying circuit 8 serves to apply a voltage of 0V or +50V to the control electrode portions 7 according to an image signal.

The cylindrical back electrode roller 22 is disposed to face the toner carry roller 14 through the apertures 6 of the aperture electrode unit 1. The back electrode roller 22 is disposed away from the aperture electrode unit 1 at an interval of about 1 mm and is rotatably supported by a chassis (not shown). Accordingly, the supporter P is insertable into a gap between the back electrode roller 2 and the aperture electrode unit 1. The back electrode roller 22 is connected to the DC power source 24, and the DC power source 24 is designed to apply a voltage of +1 kV to the back electrode roller 22.

The supporter feeding portion 40 comprises the back electrode roller 22 and the fixing device 26. The supporter P passes over the position of the back electrode roller 22, which corresponds to an image forming position, and is fed to the fixing device 26. The fixing device 26 comprises a heat roller 26A having a heat source (not shown) therein and a press roller 26B pressed against the heat roller 26A. The supporter P on which an image is formed is sandwiched by the two rollers 26A and 26B in the fixing device 26 to heat-fix a toner image and then discharged from a discharge port (not shown) to the outside of the image forming apparatus.

In operation, first, according to rotation of the toner carry roller 14 and the toner supply roller 12 in a direction as indicated by arrows of FIG. 1, the toner 16 supplied from the toner supply roller 12 is rubbed against the toner carry roller 14 to be negatively charged and is carried on the toner carry roller 14. The carried toner 16 is thinned and uniformly charged by the toner-layer restricting blade 18. Then, the toner 16 is fed toward the aperture electrode unit 1 by rotation of the toner carry roller 14. The toner 16 carried on the toner carry roller 14 is supplied to the lower side of the apertures 6 while being rubbed against the insulating sheet 2.

At this time, the conductive wiring portions 5 that correspond to an image portion are supplied with +50V by the control voltage applying circuit 8 in accordance with an image signal. As a result, lines of electric force that direct from the control electrode portions 7 to the toner carry roller 14 are formed in the vicinity of the apertures 6 corresponding to the image portion due to the potential difference between the control electrode portions 7 and the toner carry roller 14. Therefore, the negatively charged toner 16 is electrostatically attracted to a higher potential position so that it is passed from the surface of the toner carry roller 14 through the apertures 6 and drawn out to the control electrode portions 7. The drawn-out toner 16 is further electrostatically attracted toward the supporter P by an electric field formed between the supporter P and the aperture electrode unit 1 due to a voltage of +1 kV applied to the back electrode roller 22 and deposited on the supporter P to form an image.

The control electrode portions 7 corresponding to a non-image portion are supplied with a voltage of 0V from the control voltage applying circuit 8. As a result, no electric field is formed between the toner carry roller 14 and the control electrode portions 7. Thus, no electrostatic force acts on the toner 16 on the toner carry roller 14. Therefore, no toner can pass through the apertures 6.

In this embodiment, as described above, a sufficient minimum distance can be kept between the first control electrodes 3 and the conductive wiring portions 5 that are adjacent to the respective first control electrodes 3. Thus, an image forming head that induces no breakdown and no complications can be provided. Further, the conductive wiring portions 5 can be designed to have a large width so that a yield in a manufacturing process can be improved and cost can be reduced. In addition, by arranging the control electrodes while keeping the minimum gap, a very close wiring can be performed. So, that the construction of the aperture electrode unit 1 is also suitable to achieve high resolution.

The supporter P is fed in a direction perpendicular to the aperture array while a row of picture elements are formed with the toner 16 on the surface of the supporter P. By repeating the above process, a toner image is formed on the whole surface of the supporter P. Thereafter, the formed toner image is fixed onto the supporter P by the fixing device 26.

If insulating toner is used in the image forming apparatus thus constructed, electrical insulation is kept between the toner carry roller 14 and the control electrode portions 7. Thus, the apertures 6 can be prevented from breaking.

In the above process, the control electric field caused by the control electrode portions 7 is formed inside of the control electrode portions 7 and the apertures 6 and between the control electrode portions 7 and the toner carry surface of the toner carry roller 14 facing the apertures 6. Therefore, the control electric field can be directly applied to the carried toner 16, and thus a control efficiency can be increased.

Further, even when a part of the supplied toner 16 suffers a mechanical force or the like through a sliding motion between the toner 16 and the aperture electrode unit 1 causing the toner 16 to invade into the apertures 6 corresponding to a non-image portion, the toner 16 can be controlled not to pass through the apertures 6 by the electric field inside of the apertures 6. Thus, controllability of the toner 16 is excellent.

Still further, since the toner carry roller 14 and the aperture electrode unit 1 are disposed to face each other through the toner layer, these elements can be disposed away from each other at a relatively short distance. Therefore, the control voltage of the control voltage applying circuit 8 can be reduced. Thus, an inexpensive driving element can be used.

Still further, the insulating sheet 2 of the aperture electrode unit 1 is disposed to face the toner carry roller 14. Therefore, even when no toner 16 exists on the toner carry roller 14 due to failure of the toner supply system, the control electrodes 3, 4 and the toner carry roller 14 are prevented from contacting with each other. So, an electrical short-circuit between the control electrodes 3, 4 and the toner carry roller 14 is prevented. Thus, the driving element is not broken.

Still further, since the aperture electrode unit 1 and the toner 16 on the toner carry roller 14 contact with each other at an inlet port of each aperture 6, the toner 16 deposited at the inlet port of the aperture 6 is pushed out by the toner 16 that is successively supplied by the toner carry roller 14. So, the toner 16 can be prevented from being clogged due to deposition and bridging of the toner 16.

This invention is not limited to the above embodiment, and various modifications may be made without departing from the subject matter of this invention.

For example, in the above embodiment, the control voltage for the apertures 6 corresponding to the non-image portion is set to 0V. However, it may be set to a negative voltage. In this case, the electric line of force that directs from the toner carry roller 14 toward the control electrode portions 7 is formed in the vicinity of the apertures 6 corresponding to the non-image portion by the potential difference between the control electrode portions 7 and the toner carry roller 14. By this electric line of force, the negatively charged toner 16 is electrostatically attracted to a higher potential position, and no toner transfers from the surface of the toner carry roller 14. Accordingly, an image can be obtained with higher image quality.

In the above embodiment, the aperture electrode unit is used as toner flow control means. However, a mesh-shaped electrode unit as disclosed in U.S. Pat. No. 5,036,341 may be used.

Next, aperture electrode units of other embodiments according to this invention are briefly described with reference to FIGS. 4A to 9C. In the following description, the elements having the same function as the aperture electrode unit 1 of the first embodiment are represented by the same reference numerals.

Figure 4A:
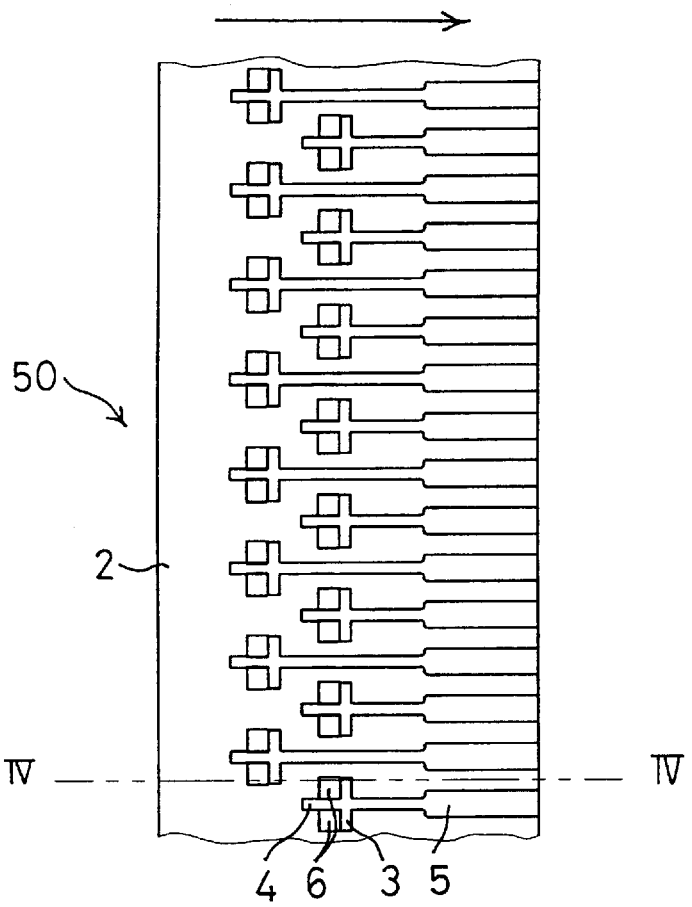
FIG. 4A is a partial plan view of an aperture electrode unit of a second embodiment according to this invention.
Figure 4B:
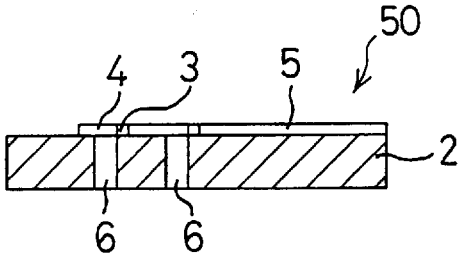
FIG. 4B is a cross-sectional side view of the aperture electrode unit of the second embodiment according to this invention.

In an aperture electrode unit 50 of a second embodiment shown in FIGS. 4A to 4B, the first control electrode 3 is disposed in a direction perpendicular to the feeding direction of the toner 16 and along the peripheral edge at the downstream side of the aperture 6 in the toner feeding direction. Except for this point, the aperture electrode unit 50 of this embodiment has the same construction as the aperture electrode unit 1 of the first embodiment.

Figure 5A:
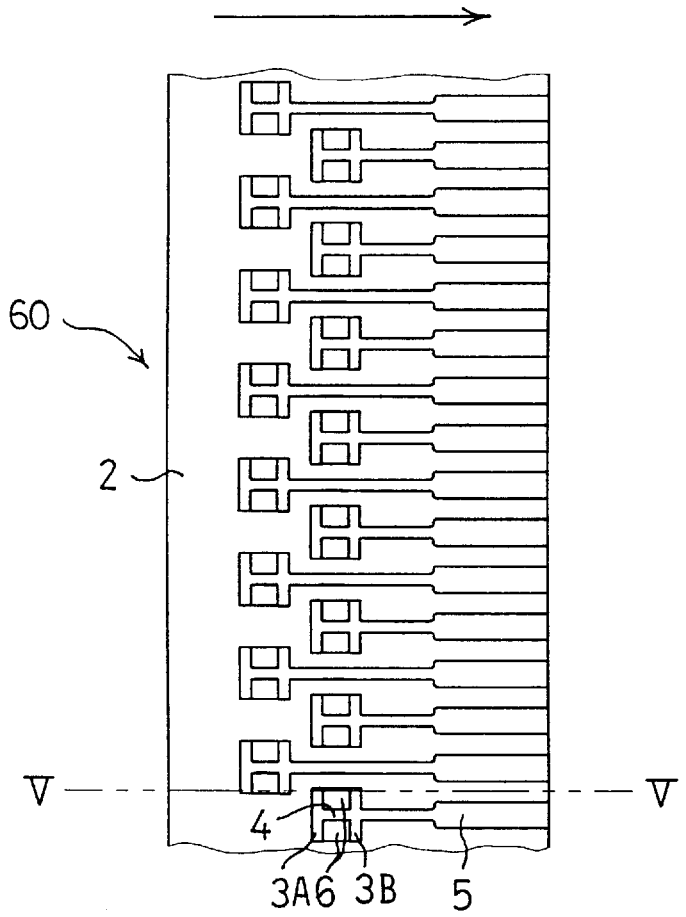
FIG. 5A is a partial plan view of an aperture electrode unit of a third embodiment according to this invention.
Figure 5B:
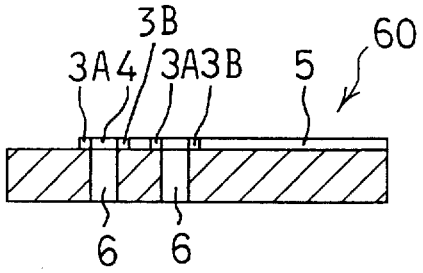
FIG. 5B is a cross-sectional side view of the aperture electrode unit of the third embodiment according to this invention.

In an aperture electrode unit 60 of a third embodiment shown in FIGS. 5A and 5B, the first control electrodes 3A and 3B are disposed in a direction perpendicular to the toner feeding direction and along both peripheral edges at the upstream and downstream sides of the aperture 6 in the toner feeding direction. Further, the conductive wiring portion 5 is connected to the substantially central portion of the first control electrode 3B disposed along the peripheral edge of the aperture 6 at the downstream side of the toner feeding direction. Except for this point, the third embodiment has the same construction as the aperture electrode unit 1 of the first embodiment.

Figure 6A:
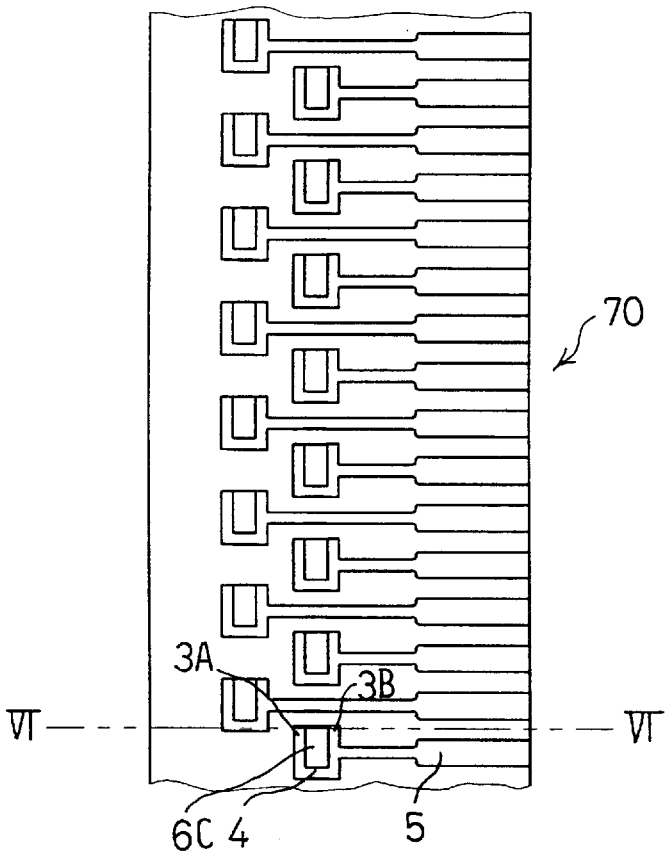
FIG. 6A is a partial plan view of an aperture electrode unit of a fourth embodiment according to this invention.
Figure 6B:
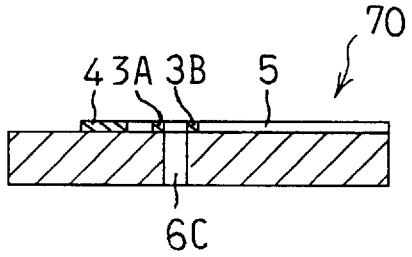
FIG. 6B is a cross-sectional side view of the aperture electrode unit of the fourth embodiment according to this invention.
Figure 6C:
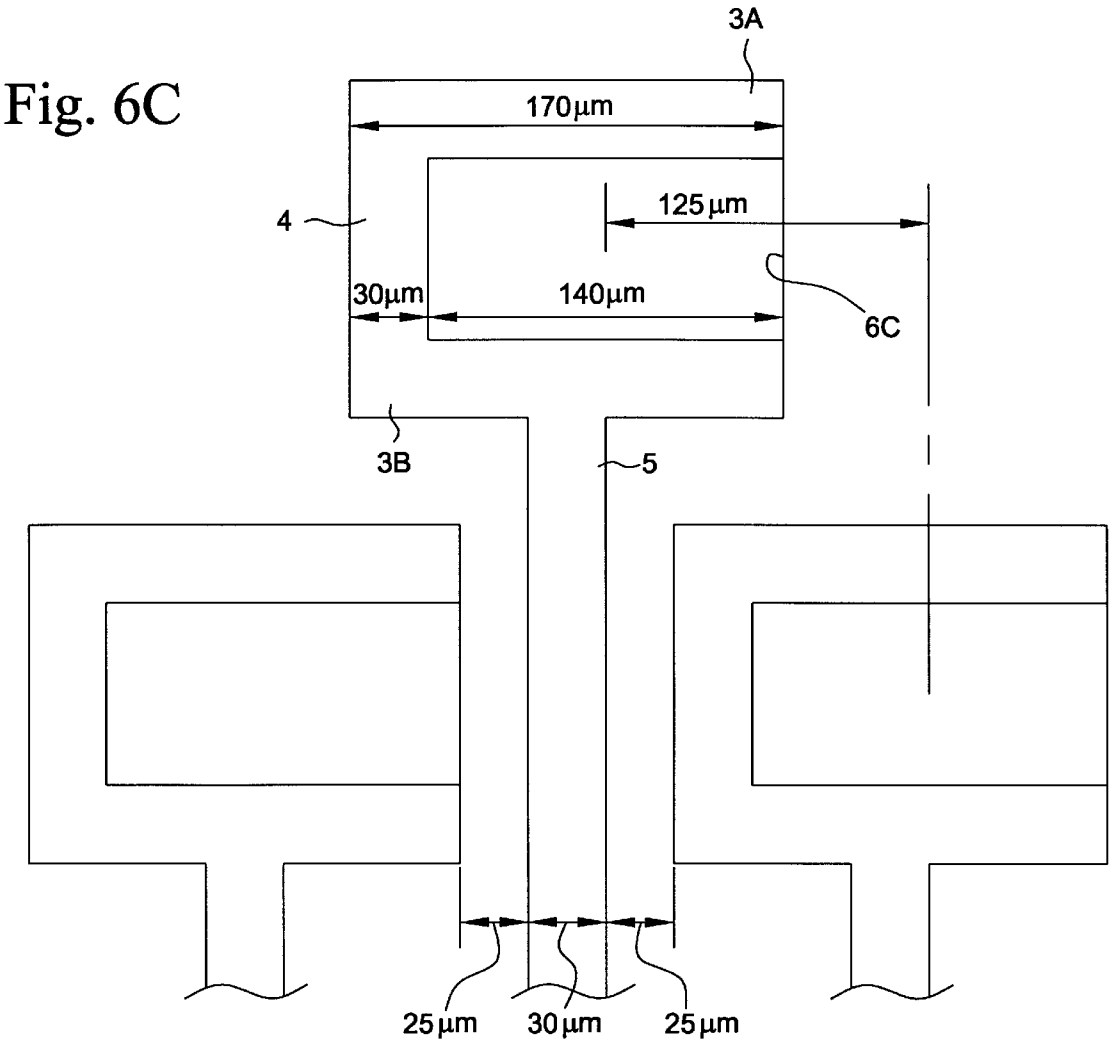
FIG. 6C is an enlarged plan view of a part of the aperture electrode unit of the fourth embodiment according to this invention.

In an aperture electrode unit 70 of a fourth embodiment shown in FIGS. 6A to 6C, the aperture 6C comprises a central opening, and the first control electrodes 3A and 3B are disposed along the peripheral edges of the aperture 6C at the upstream and downstream sides of the toner feeding direction and in a direction perpendicular to the toner feeding direction. The second control electrode 4 is disposed at one edge of the aperture 6C to connect the ends of the first control electrodes 3A and 3B to each other. The conductive wiring portion 5 is connected to the substantially central portion of the first control electrode 3B disposed at the peripheral edge of the aperture 6C at the downstream side of the toner feeding direction. Except for this point, the fourth embodiment has the same construction as the aperture electrode unit 1 of the first embodiment.

Figure 7A:
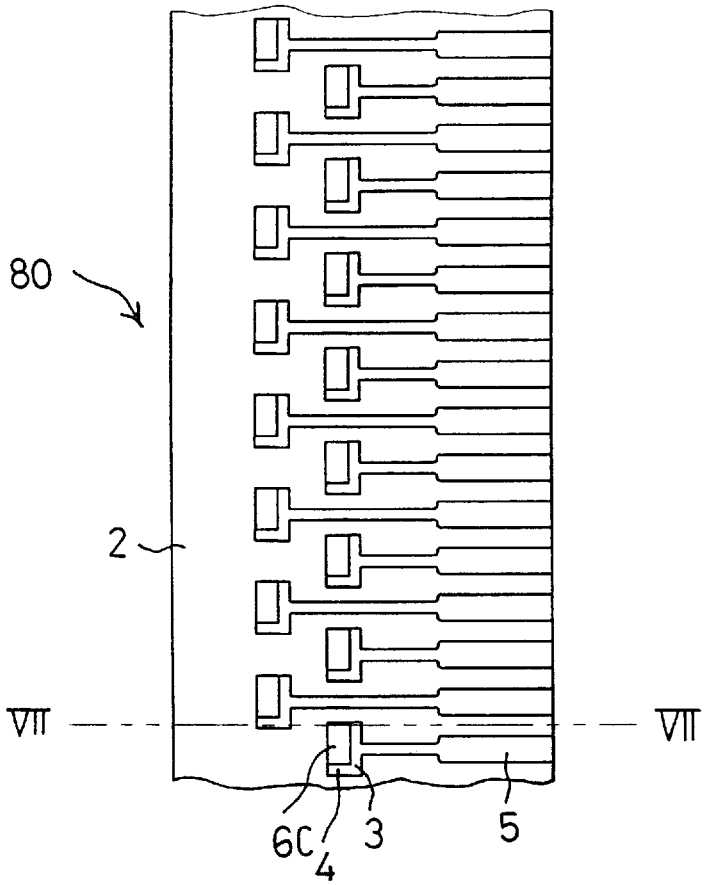
FIG. 7A is a partial plan view of an aperture electrode unit of a fifth embodiment according to this invention.
Figure 7B:
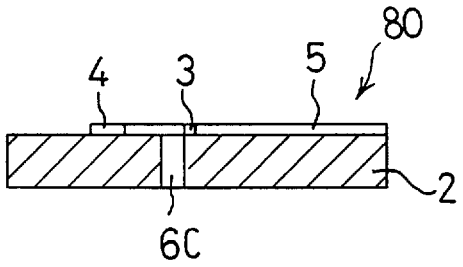
FIG. 7B is a cross-sectional side view of an aperture electrode unit of the fifth embodiment according to this invention.

In an aperture electrode unit 80 of a fifth embodiment shown in FIGS. 7A and 7B, an aperture 6C comprises one opening, and the first control electrode 3 and the second control electrode 4 are disposed in a substantially L-shaped form along the peripheral edges of the aperture 6C. The conductive wiring portion 5 is connected to the substantially central portion of the first control electrode 3. Except for this point, the fifth embodiment has the same construction as the aperture electrode unit 1 of the first embodiment.

Figure 3B:
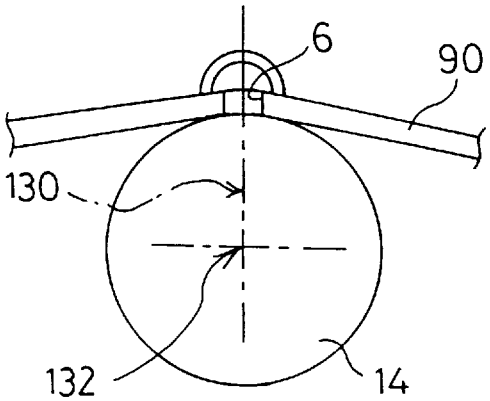
FIG. 3B is a schematic view showing the positional relationship between an aperture electrode unit having apertures arranged in a row and a toner carry roller.
Figure 8A:
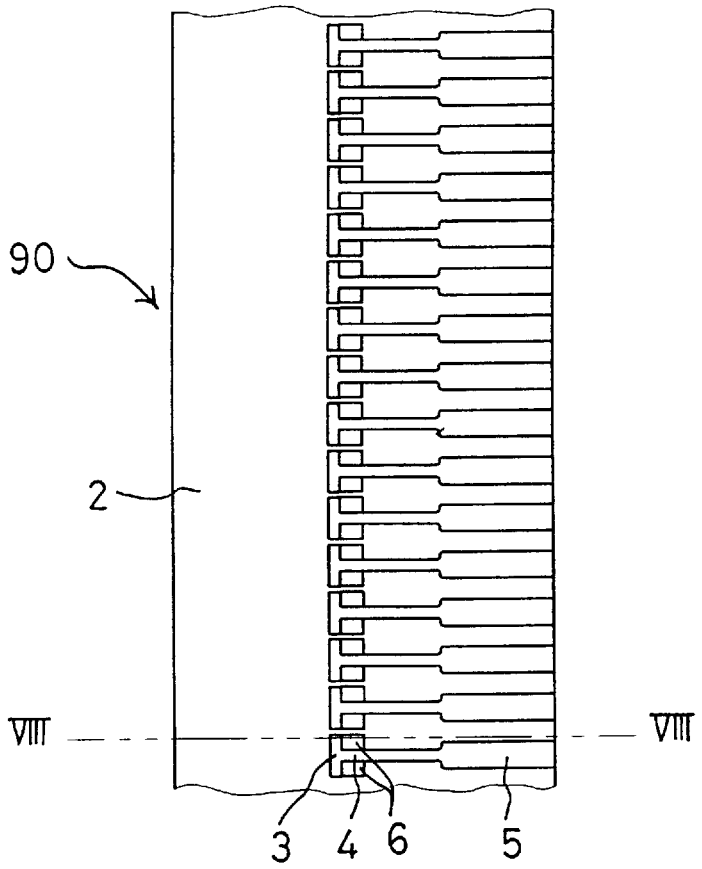
FIG. 8A is a partial plan view of an aperture electrode unit of a sixth embodiment according to this invention.
Figure 8B:
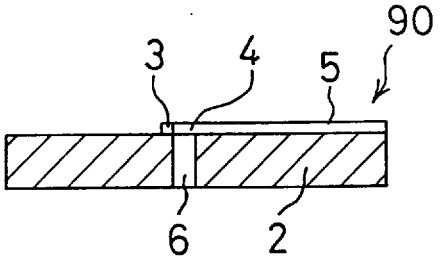
FIG. 8B is a cross-sectional side view of the aperture electrode unit of the sixth embodiment according to this invention.
Figure 8C:
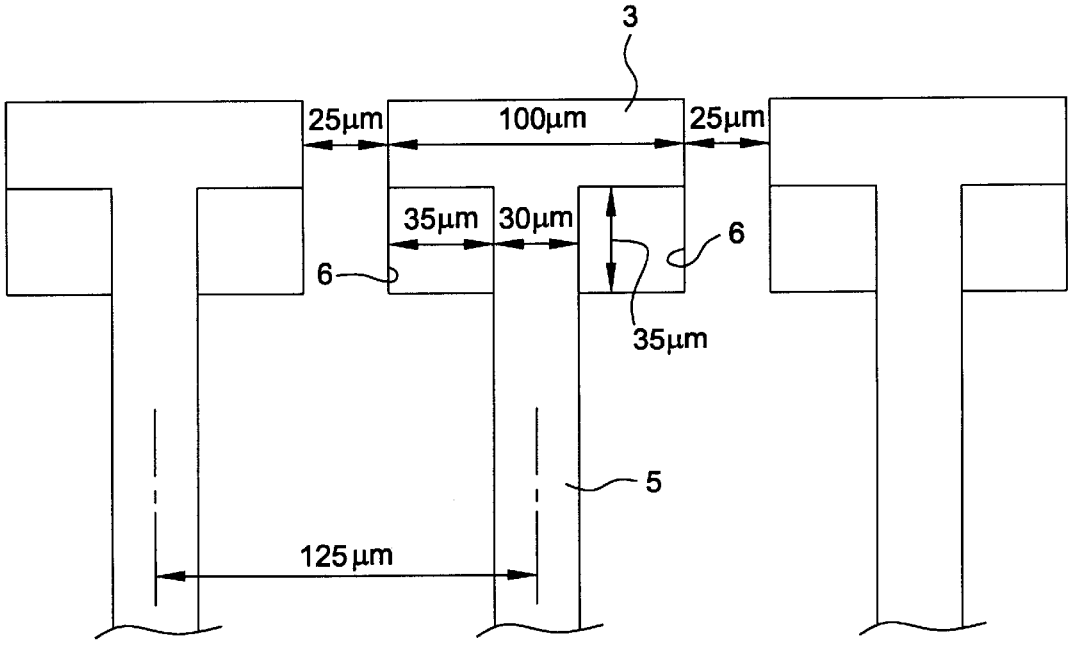
FIG. 8C is an enlarged view of a part of the aperture electrode unit of the sixth embodiment according to this invention.

In an aperture electrode unit 90 of a sixth embodiment shown in FIGS. 8A through 8C, apertures 6 are disposed on a straight line. Except for this point, this embodiment has the same construction as the first embodiment as shown in FIGS. 2A and 2B. The detailed positional relationship between the apertures 6 of the aperture electrode unit 1 and the toner carry roller 14 in this case is as shown in FIG. 3B. That is, each aperture 6 is disposed so that the central line 130 thereof passes over the uppermost portion of the peripheral surface of the toner carry roller 14 and the central axis 132 of the toner carry roller 14. With this arrangement, each aperture 6 is disposed to be symmetrical at right and left sides with respect to the uppermost portion of the peripheral surface of the toner carry roller 14. Thus, the toner 16 passing through each aperture 6 can be uniformly distributed over the whole area of the aperture 6. Further, the wall surface of the aperture 6 and the transfer direction of the toner 16 are parallel to each other, so that the toner 16 can transfer stably.

Further, the aperture electrode unit 1 itself is pressed against the toner carry roller 14 so that it can be bent to the right and left sides by the same angle with the aperture 6 at the center thereof as shown in FIG. 3B. Accordingly, the contact area between the aperture electrode unit 1 and the toner carry roller 14 can be increased, and the periphery of the lower portion of the aperture 6 can be pressed uniformly at the right and left sides thereof. So, the occurrence of non-uniformity of toner density can be maximally prevented.

Figure 9A:
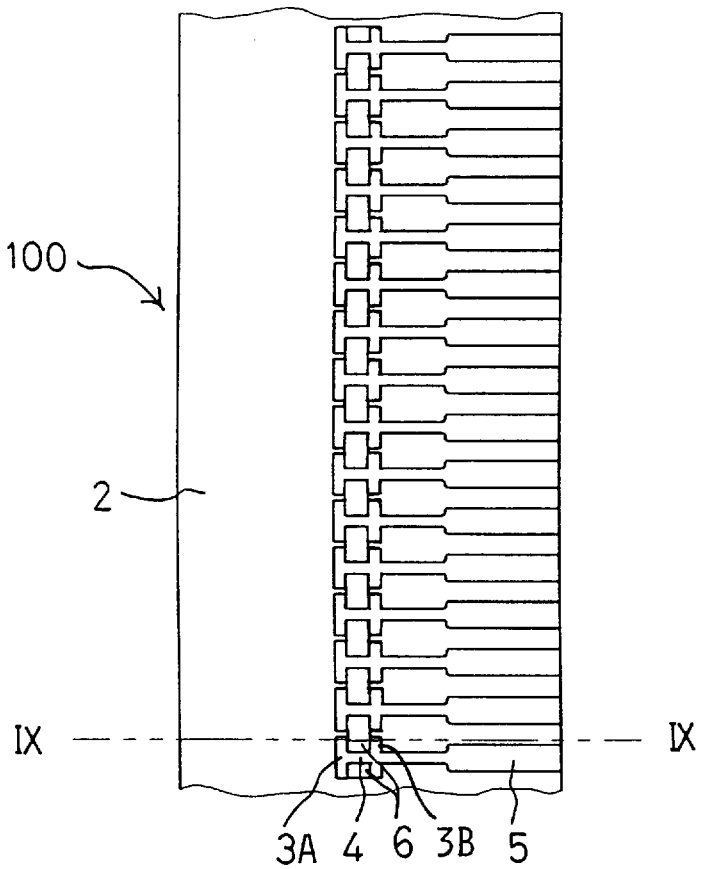
FIG. 9A is a partial plan view of an aperture electrode unit of a seventh embodiment according to this invention.
Figure 9B:
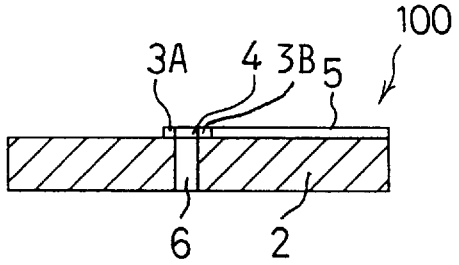
FIG. 9B is a cross-sectional side view of the aperture electrode unit of the seventh embodiment according to this invention.
Figure 9C:
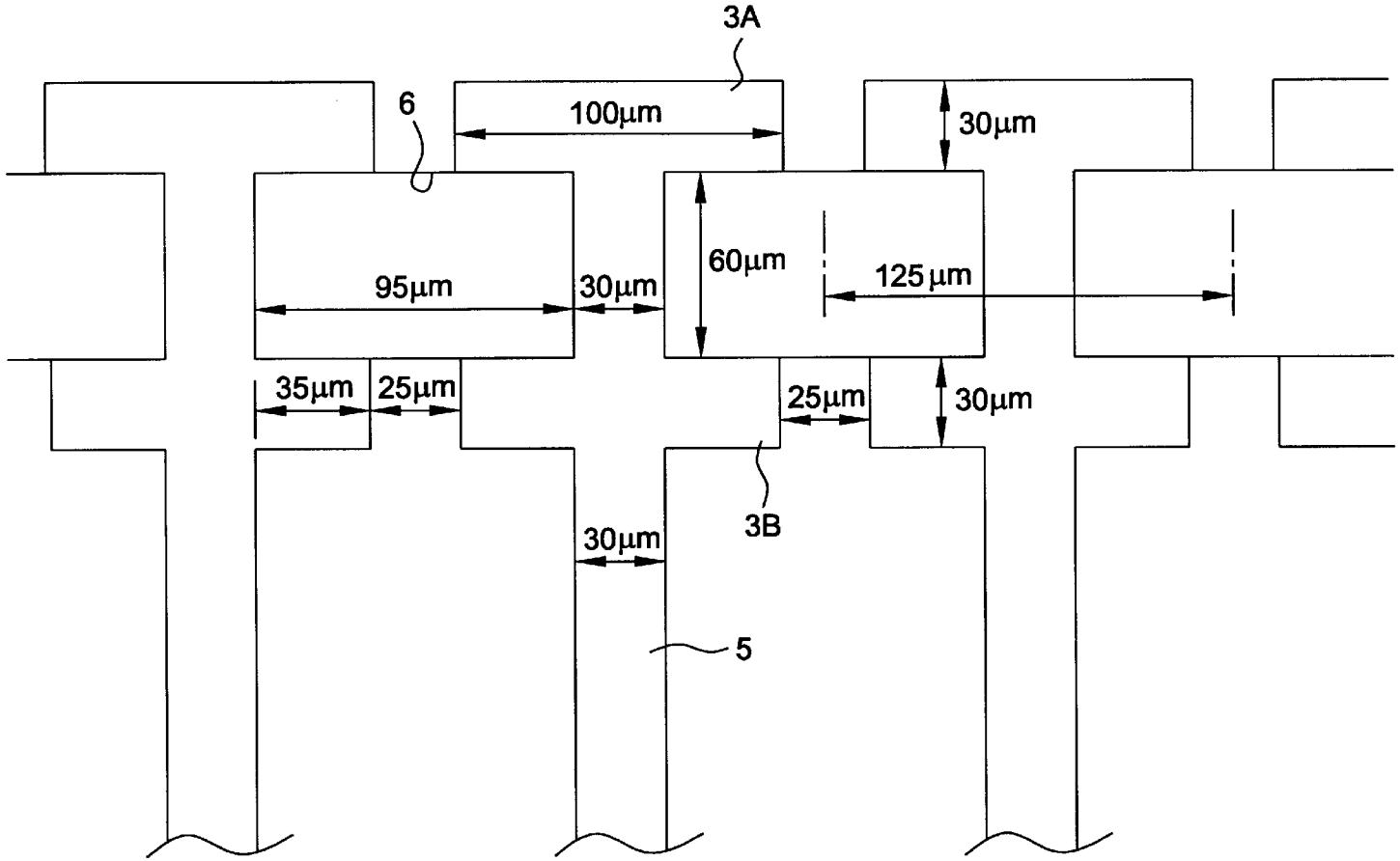
FIG. 9C is an enlarged view of a part of the aperture electrode unit of the seventh embodiment according to this invention.
Figure 10:
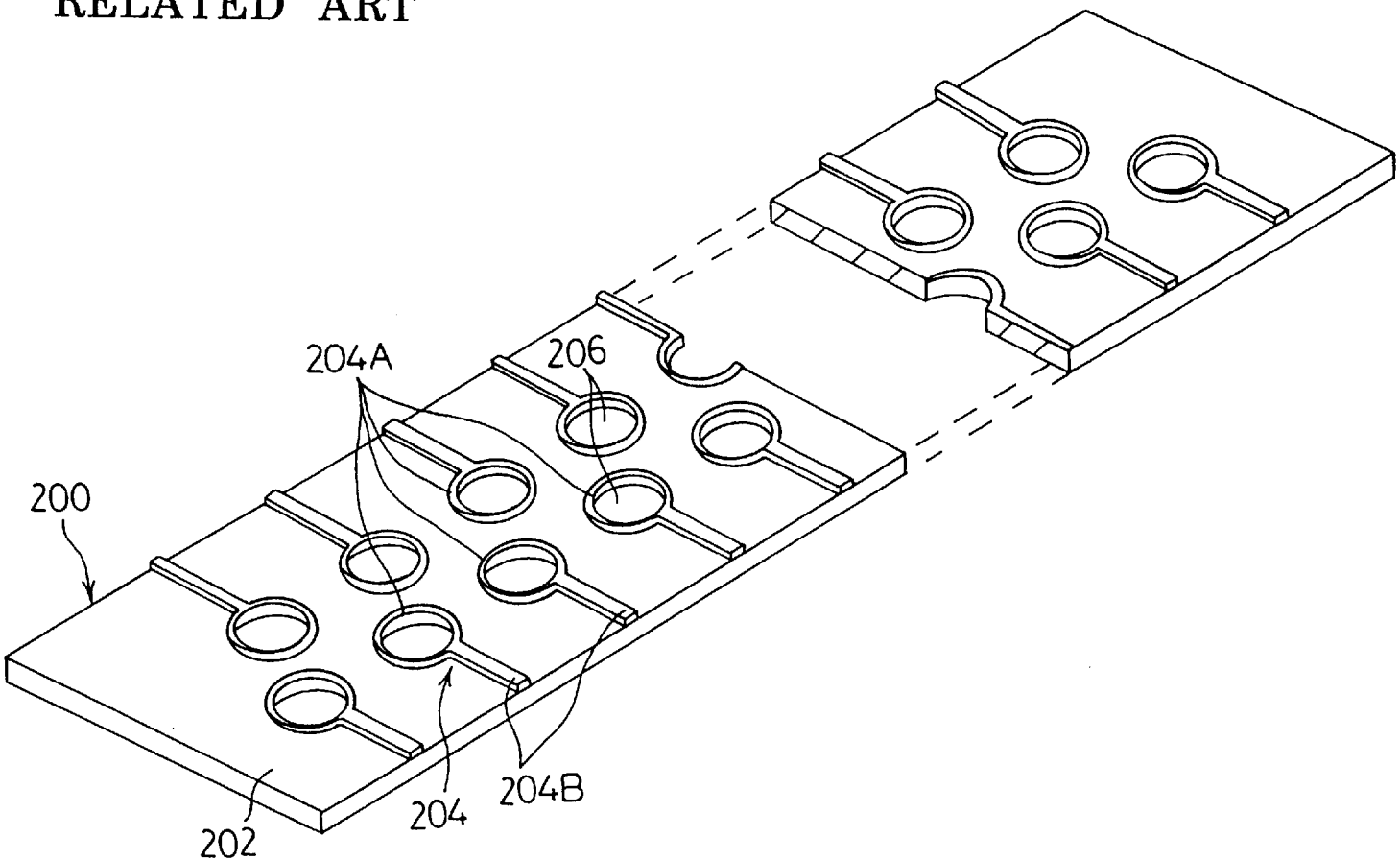
Fig.10 RELATED ART
FIG. 10 is a perspective view of a related aperture electrode unit discussed in the background of this specification.
Figure 11A:
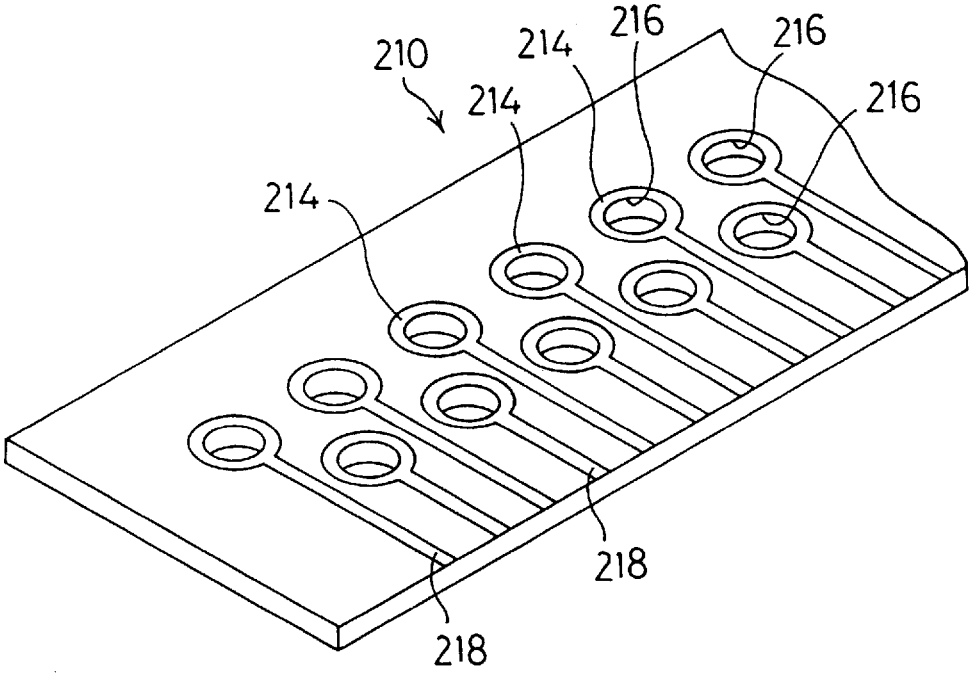
Fig.11A RELATED ART
FIG. 11A is a perspective view of another related aperture electrode unit discussed in the background of this specification.
Figure 11B:
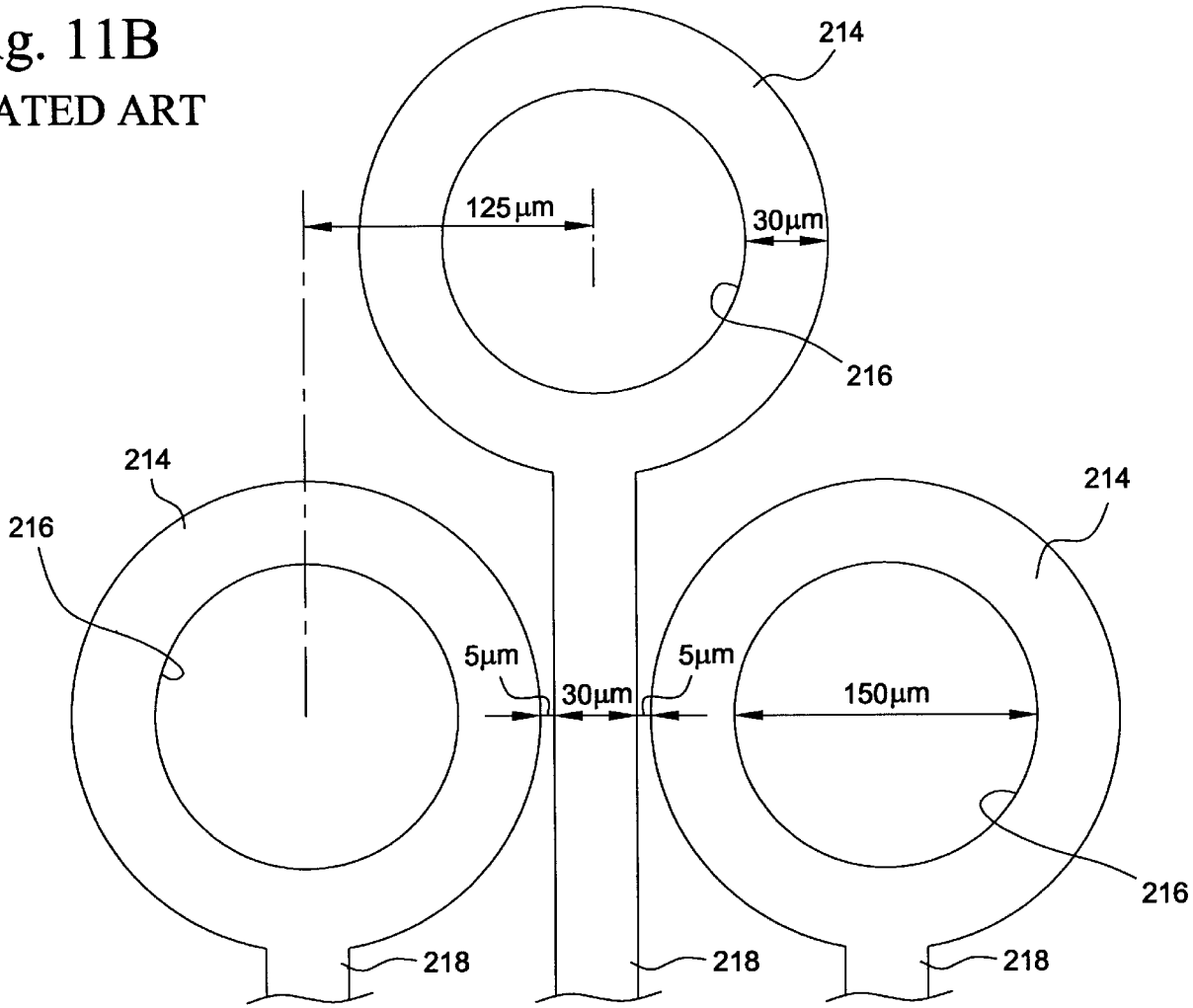
Fig. 11B RELATED ART
FIG. 11B is an enlarged front view of a part of another related aperture electrode unit discussed in the background of this specification.

In an aperture electrode unit 100 of a seventh embodiment shown in FIGS. 9A to 9C, apertures 6 are arranged on a straight line like the aperture electrode unit 90 of the sixth embodiment. However, unlike the aperture electrode unit 90 of the sixth embodiment, one aperture is commonly used by two control electrodes. With this construction, apertures 6 having a larger size than the apertures 6 of the aperture electrode unit 90 of the sixth embodiment can be obtained.

By arranging the apertures 6 in a row like the aperture electrode 90 of the sixth embodiment and the aperture electrode unit 100 of the seventh embodiment, the toner 16 that is substantially uniformly thinned by the toner layer restricting blade 18 can be directly supplied to the respective apertures 6. Accordingly, the image forming apparatus using the aperture electrode unit 90 of the sixth embodiment or the aperture electrode unit 100 of the seventh embodiment can obtain a more clear and accurate recording image than the image forming apparatus using the aperture electrode units of the other embodiments in which the apertures 6 are arranged in a staggered form.

However, in any embodiment, no discharge occurs between the control electrodes 3 and the conductive wiring portions 5 that are adjacent to each other. So, the same effect as the aperture electrode unit 1 of the first embodiment can be expected.

What is claimed is:

1. An image forming apparatus that forms an image on a supporter with toner, comprising:

a toner supply that supplies charged toner to the supporter in a supply direction; and a toner flow controller confronting the toner supply that controls a flow of charged toner from the toner supply to the supporter with selective application of an electric field, the toner flow controller having plural apertures therein aligned in at least one row that allow the charged toner to pass therethrough, the apertures being defined by an upstream peripheral edge disposed upstream of the toner supply direction, a downstream peripheral edge disposed downstream of the toner supply direction, and a pair of side edges, the toner flow controller also having a plurality of control electrodes provided on at least one of the peripheral edges of each of the apertures and having conductive wiring extending longitudinally therefrom downstream of the toner supply direction, wherein at least a portion of the edge defining each aperture does not have a control electrode thereon; and wherein the control electrodes are spaced from each other by at least 10 $\mu$m such that electrical discharge does not occur between adjacent control electrodes and wherein each of the control electrodes comprises a first control electrode portion extending perpendicular to the toner supply direction on a peripheral edge of one of the apertures, and at least one second control electrode portion integral with the first control electrode portion extending parallel to the toner supply direction on a peripheral edge of the aperture.

2. The image forming apparatus of claim 1 wherein the toner flow controller includes an insulating sheet having two opposed surfaces, wherein the control electrodes and the conductive wiring are formed on one surface of said insulating sheet and the toner supply confronts the other surface of the insulating sheet.

3. The image forming apparatus of claim 1 wherein the apertures are arranged in two staggered rows.

4. The image forming apparatus of claim 1 wherein the control electrodes are disposed on the upstream peripheral edge of the apertures.

5. The image forming apparatus of claim 1 wherein the control electrodes are disposed on the downstream peripheral edge of the apertures.

6. The image forming apparatus of claim 1 wherein the control electrodes are disposed on both the upstream and downstream peripheral edges of the apertures.

7. The image forming apparatus of claim 1 wherein the control electrodes are disposed on at least one side edge of the apertures.

8. The image forming apparatus of claim 1 wherein the control electrodes are disposed on one of the edges in the pair of side edges of the apertures, wherein adjacent apertures each have a control electrode disposed on a similarly positioned one side edge.

9. The image forming apparatus of claim 1 wherein the control electrodes are disposed on one side edge of the apertures, wherein adjacent apertures have a control electrode on adjacent side edges.

10. The image forming apparatus of claim 1 wherein the control electrodes are disposed on both side edges of the apertures.

11. The image forming apparatus of claim 1 wherein the control electrodes are substantially T-shaped.

12. The image forming apparatus of claim 1 wherein the control electrodes are substantially L-shaped.

13. The image forming apparatus of claim 1 wherein the control electrodes are substantially H-shaped.

14. The image forming apparatus of claim 1 wherein the control electrodes are substantially U-shaped.

15. The image forming apparatus of claim 1 wherein the apertures are rectangular.

16. An electrode unit for directly controlling a flow of charged particles with an electric field, comprising:

an insulating member having a longitudinal axis and a plurality of aligned apertures therein, each of the apertures being defined by a peripheral edge; and control electrodes provided on the insulating member arranged to be electrically insulated from one another and disposed on at least a part of the peripheral edge of each aperture, wherein at least a portion of the edge defining each aperture does not have a control electrode thereon, the control electrodes including conductive wiring portions extending substantially parallel to the longitudinal axis and connected to a control voltage source, wherein the control electrodes selectively apply a voltage from the control voltage source to control the flow of charged particles and are spaced from each other by at least 10 $\mu$m such that electrical discharge does not occur between adjacent control electrodes, wherein each of the control electrodes comprises a first control electrode portion extending perpendicular to the longitudinal axis on a peripheral edge of one of the apertures, and at least one second control electrode portion integral with the first control electrode portion extending parallel to the longitudinal axis on a peripheral edge of the aperture.

17. The electrode unit of claim 16, wherein the plurality of apertures are arranged in two staggered rows.

18. The electrode unit of claim 16, wherein the predetermined distance is measured from an end of one of the first control electrode portions of one control electrode to the conductive wiring of an adjacent control electrode.

19. The electrode unit of claim 16, wherein the predetermined distance is measured from an end of one of the first control electrode portions of one control electrode to an end of one of the first control electrode portions of an adjacent control electrode.

20. The electrode unit of claim 16, wherein one of the second control electrode portions is disposed directly between a pair of adjacent apertures and is located on the peripheral edge of both apertures.

21. The electrode unit of claim 16 wherein each of the apertures is rectangular and has an outer peripheral edge, an inner peripheral edge, and a pair of side edges, wherein the outer and inner peripheral edges extend generally perpendicular to the longitudinal direction and the side edges extend generally parallel to the longitudinal direction.

22. The electrode unit of claim 21 wherein the control electrodes are disposed on at least one of the outer and inner peripheral edges and at least one of the side edges of an aperture.

23. An electrode unit for directly controlling a flow of charged particles with an electric field, comprising:

an insulating member having a longitudinal axis and a plurality of aligned apertures therein, the apertures being defined by a peripheral edge; and control electrodes provided on the insulating member arranged to be electrically insulated from one another and disposed on at least a part of the peripheral edge of each aperture, wherein at least a portion of the edge defining each aperture does not have a control electrode thereon, the control electrodes including conductive wiring portions extending substantially parallel to the longitudinal axis, wherein the control electrodes selectively apply a voltage to control the flow of charged particles and are spaced from each other by at least 10 $\mu$m such that electrical discharge does not occur between adjacent control electrodes.

24. The electrode unit of claim 23, wherein each of the control electrodes comprises a first control electrode portion extending perpendicular to the longitudinal direction on a peripheral edge of one of the apertures, and at least one second control electrode portion integral with the first control electrode portion extending parallel to the longitudinal direction on a peripheral edge of the aperture.

25. The electrode unit of claim 24, wherein each of the control electrodes comprises a first control electrode portion extending perpendicular to the longitudinal direction on a peripheral edge of one of the apertures, and at least one second control electrode portion integral with the first control electrode portion extending parallel to the longitudinal direction on a peripheral edge of the aperture.

* * * * *